United States Patent [19]

Mertz

[11] 4,437,833

[45] Mar. 20, 1984

[54] INFRARED RADIATING BURNER ARTICLE

[75] Inventor: Frank D. Mertz, Bergenfield, N.J.

[73] Assignee: Red-Ray Manufacturing Company, Inc., Cliffside Park, N.J.

[21] Appl. No.: 233,851

[22] Filed: Mar. 5, 1981

[51] Int. Cl.[3] ..... F23D 13/14

[52] U.S. Cl. ..... 431/329; 431/328; 431/100; 126/92 B

[58] Field of Search ..... 431/329, 328, 100; 126/92 B

[56] References Cited

U.S. PATENT DOCUMENTS

| | | | |
|---|---|---|---|
| 2,336,816 | 12/1943 | Thompson | 431/100 X |
| 3,258,058 | 6/1966 | Lherault et al. | 431/329 |
| 3,784,353 | 1/1974 | Chapurin | 431/329 |
| 3,805,763 | 4/1974 | Cowan | 431/329 X |
| 3,814,573 | 6/1974 | Karlonetz | 431/329 |
| 3,847,536 | 11/1974 | Lepage | 431/329 |
| 4,039,275 | 8/1977 | McGettrick | 431/329 |

*Primary Examiner*—Larry Jones

*Attorney, Agent, or Firm*—George H. Gerstman

[57] ABSTRACT

An infrared radiating burner article, for generating infrared radiation. The article is connectable to a system for mixing air and gas and supplying such air/gas mixture thereto.

The structure includes a housing, having an opening extending therethrough through which the air/gas mixture may be fired in use. The structure further includes diffuser plates, for diffusing the air/gas mixture upon firing thereof through the housing opening so as to generate substantial pressure in such air/gas mixture. The diffuser plate is secured in the housing opening in the path of movement of the air/gas mixture upon firing thereof through the housing opening. The structure further includes a refractory grid, positioned in the housing opening in the path of movement of the air/gas mixture. The refractory grid is positioned at a point in the housing opening beyond the location of the diffuser plates. The air/gas mixture is fed through the refractory grid. The refractory grid includes a surface thereof facing outwardly from the housing. The air/gas mixture is ignited so as to burn on the outwardly-facing surface of the refractory grid, to generate infrared radiation. The refractory grid includes a substantial outwardly-facing surface area, so as to generate substantial amounts of infrared radiation, and a reverbatory screen for radiating infrared.

The article enables the air/gas mixture to be fired through the refractory grid, under pressure generated by movement of the air/gas mixture through the diffuser plates, and the ignited air/gas mixture burns on the surface of the refractory grid and heats same so as to generate substantial amounts of infrared radiation at a particular gas pressure, in a rapid and efficient manner.

7 Claims, 4 Drawing Figures

INFRARED RADIATING BURNER ARTICLE

BACKGROUND OF THE INVENTION

1. Field of the Invention

The present invention is in the field of burner devices and, more particularly, an infrared radiating burner article, for generating infrared radiation.

2. Description of the Prior Art

It is presently known to provide an article, operable in the infrared radiation band of the electromagnetic spectrum, which functions as a burner to heat a product. The article utilizes the known heating properties of infrared radiation for heating the product. The article typically includes a refractory, which is a radiating body, the surface of which absorbs radiation incident thereon and emits radiation therefrom. Such refractory, when heated, transfers heat from the burner to the product being heated in a directional manner, permitting heat to be applied at predetermined locations.

The article may be utilized for various applications, and is particularly useful where substantial heat penetration is desired. Such applications may typically include the drying of material moving on a conveyor or web. Radiant gas burners require little room for installation, and may be installed where space llimitations restrict adding conventional dryers, as in ovens. Oven manufacturers use infrared gas burners as heat sources, since they provide rapid preheating of the product, and the combusted gas provides appropriate dwell-curing time temperatures. Continuous or conveyorized heat processing or drying applications are typically speeded up, and the quality improved, through the use of gas-fired infrared energy.

The article may typically comprise an atmospheric-type burner, in which air and gas are premixed to form an air/gas mixture, delivered to the burner. The air/gas mixture is ignited and directed at the top surface so as to heat the refractory. Such heating produces a flux of substantial radiance, radiating from the surface of the refractory to the product being heated.

Still further, such articles presently known are rigidly secured to a common manifold, and the entire burner and manifold assembly must be returned to the manufacturer for replacement of the burner alone. Such procedure required to replace burners is highly expensive and inefficient. When a refractory in a presently known article requires replacement, the manufacturer recommends that the entire burner should be returned to the manufacturer, as such refractory is sealed in the burner housing. Such a procedure is also very expensive and highly inefficient.

It is normally necessary, pursuant to presently known devices, to use substantial quantities of gas to attain a quantity of infrared radiation output therefrom, which is highly inefficient and costly. However, if less gas is used, less infrared radiation is generated. It is further normally necessary in such burner devices, to utilize a relatively long period of time for generating infrared radiation upon starting the system up and for dissipating infrared radiation upon shutting the system down. This approach imposes substantial expense and inefficiency upon the burner structure. The relatively long period of time required to generate infrared radiation is highly inefficient and expensive. The relatively long period of time required to dissipate infrared radiation subjects the material being heated within the range of residual infrared radiation emitted by the refractory to damage by virtue of elevation of the temperature thereof. Still further, presently known burner structures are positionable so as to radiate infrared upwardly, to prevent deterioration of the refractory surface which could occur in other positions as a consequence of the ignited air/gas mixture flowing back over the refractory surface. The intended use of the structure, however, may be such as to make orientation in a position other than such position more economical and efficient. Other orientations are not feasible with presently known devices. Still further, burners presently known may be secured to a manifold, and refractories may be secured to the burner, such as to require return of the entire assembly to the manufacturer for replacement of the burner or refractory, which are further highly inconvenient and expensive.

Thus, particular problems arise. If presently known structures are utilized, such structures utilize substantial quantities of gas in generating a quantity of infrared radiation, which is very expensive and inefficient. However, if less gas is utilized, less heat is generated, which is also highly inefficient. Further, such structures require a relatively substantial period of time to generate and dissipate infrared radiation when starting up and shutting down, resulting in inefficiencies in the operation thereof and increased expense therein, and subjecting the material being heated to possible damage thereto as a consequence of residual infrared radiation elevating the temperature thereof. Further, presently known structures may typically be oriented in one position only, such that infrared is radiated upwardly, thereby preventing use in more efficient orientations. Such burner articles may be secured to assemblies, and refractories secured to the burner, so as to require return of the entire assembly for repair or replacement of parts, which is also highly inefficient and expensive.

SUMMARY OF THE INVENTION

The present invention provides an infrared radiating burner article, which reduces the amount of gas used in generating a quantity of infrared radiation output, which rapidly generates infrared radiation upon starting the system up, which rapidly dissipates infrared radiation upon shutting the system down, which enables orientation of the structure in any position desired relative to the material to be heated, and which enables replacement of burners and refractories at the user's place of business in a convenient and efficient manner.

The improvements in infrared radiating burner structures are provided by use of an infrared radiating burner structure which is connectable to a system for mixing air and gas and supplying such air/gas mixture thereto. The structure includes a housing having an opening extending therethrough through which the air/gas mixture may be fired in use. The structure further includes diffuser plates, for diffusing the air/gas mixture upon firing thereof through the housing opening so as to generate substantial pressure in such air/gas mixture, secured in the housing opening in the path of movement of the air/gas mixture upon firing thereof through the housing opening. The structure further includes a refractory grid, positioned in the housing opening in the path of movement of the air/gas mixture thereof through the housing opening. The refractory grid is positioned at a point in the housing opening beyond the location of the diffuser plates. The air/gas mixture is fired through the refractory grid. The refractory grid includes a surface thereof facing outwardly from the housing. The air/gas mixture is ignited so as to burn on the outwardly-facing surface of the refractory grid, to generate infrared radiation. The refractory grid includes a substantial outwardly-facing surface area, so as to generate substantial quantities of infrared radiation. The article fires the air/gas mixture through the refractory grid, under pressure generated by the movement of the air/gas mixture through the diffuser plates, and the ignited air/gas mixture burns on the surface of the refractory grid and heats same so as to generate substantial quantities of infrared radiation at a particular gas pressure, in a rapid and efficient manner. The article further includes a wire scree, detachably connected to the housing so as to be spaced from the outwardly-facing surface of the refractory grid in the path of infrared radiation generated thereby, for reverberating infrared radiation generated by the refractory grid, so as to aid in the distribution of such heat generated, increase the intensity thereof, and generate high density infrared radiation flux of maximum density. The wire screen is removable to enable removal and replacement of the refractory positioned in spaced relation thereto. The article still further includes a threaded connector portion of the housing, which enables detachable connection thereof to a manifold, to enable replacement of the burner at the user's place of business in a convenient and efficient manner. The article still further includes insulation, positioned intermediate the refractory grid and housing so as to insulate the housing from the refractory grid, and to insulate the article from adjacent articles. Flexible sealant flexibly seals the refractory grid and insulation in the housing, which sealant is removable to enable replacement of the refractory at the user's place of business in a convenient and efficient manner. The insulation and flexible sealant take up expansion and contraction of the refractory grid, and prevent cracking thereof.

The infrared radiating burner structure of the present invention has utility in heating materials, particularly materials conveyed in commercial conveying operations in the path of infrared radiating from such structures for heating such materials.

The novel features which are characteristic of the invention, both as to structure and method of operation thereof, together with further objects and advantages thereof, will be understood from the following description, considered in connection with the accompanying drawings in which several preferred embodiments of the invention are illustrated by way of example. It is to be expressly understood, however, that the drawings are for the purpose of illustration and description only, and are not intended as a definition of the limits of the invention.

DESCRIPTION OF THE DRAWINGS

The invention is illustrated, by way of example thereof in the accompanying drawings, wherein:

FIG. 4 is a top view thereof.

DESCRIPTION OF THE PREFERRED EMBODIMENT

Figure 1:
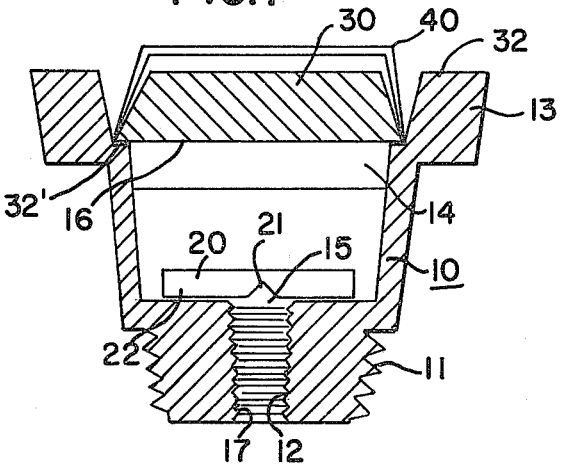
FIG. 1 is a side elevational cross-sectional view of an infrared radiating burner article pursuant to the invention.
Figure 2:
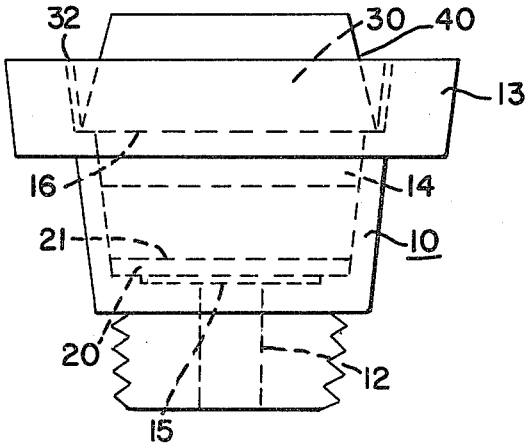
FIG. 2 is a side elevational view thereof.
Figure 3:
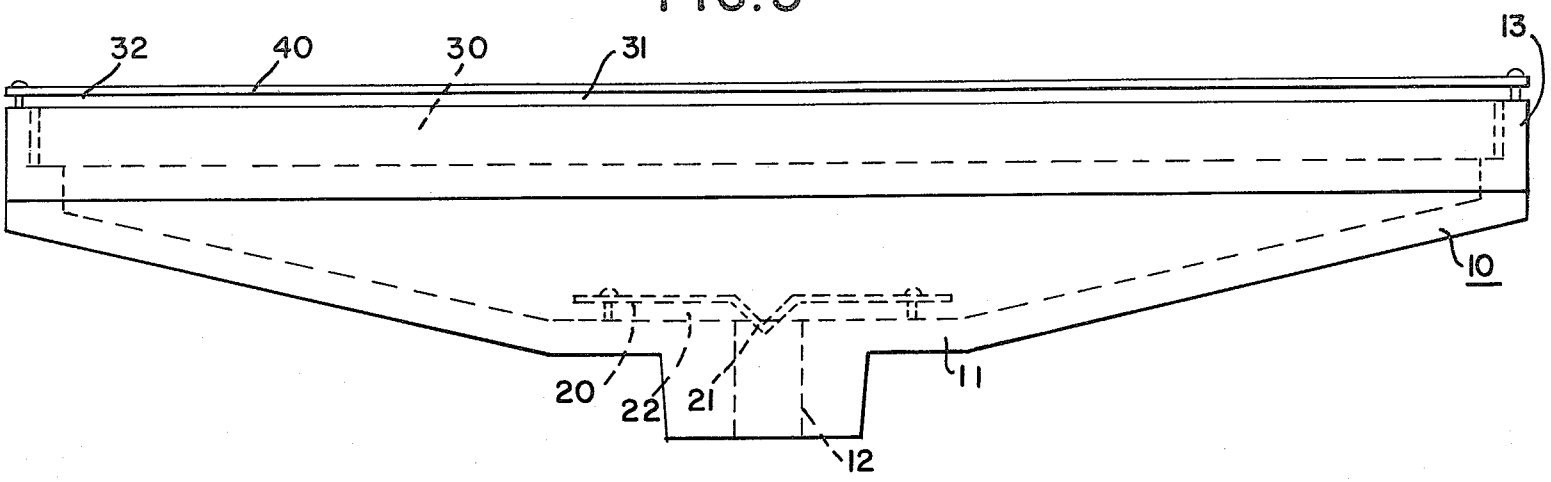
FIG. 3 is a front elevational view of the infrared radiating burner article pursuant to the invention.

Referring to the drawings, FIGS. 1–5 show an infrared radiating burner article for use in a commercial operation for heating a product.

There are shown in FIGS. 1–4 side, cross-sectional, and elevational views of the infrared radiating burner article in the preferred embodiment thereof. It is necessary for use of such article to generate infrared radiation in an efficient and economical manner.

Generally, it is desirable to enable detachable connection of such articles to a common manifold in forming assemblies thereof, and detachable connection of a wire screen to the burner housing, such that replacement of articles or refractories may be effectuated at the user's place of business in a convenient and efficient manner.

The present invention enables such objectives to be satisfied by means of a novel composite burner structure. The infrared radiating burner article includes a housing 10, which includes a first portion 11 having a restricted opening 12 therethrough, and a second portion 13, having a enlarged opening 14 therethrough, communicating at portion 15 with the restricted opening 12 in first portion 11 so as to form a continuous opening through housing 10. The article is connectable to a system for mixing air and gas and supplying such air/gas mixture thereto. A ledge 16 extends about the walls of the enlarged opening 14 in the housing 10, for enabling a connector portion of a manifold to be detachably connected thereto. Threads 17 on first portion 11, which enable detachable connection of housing 10 to the manifold, enable replacement of burner articles at the user's place of business in a convenient and efficient manner. The manifold directs the air/gas mixture through the opening extending through housing 10, specifically through restricted opening 12, communicating portion 15, and enlarged opening 14.

The structure further includes diffuser plates for generating substantial pressure in the air/gas mixture as it is fired through the opening extending through housing 10, which diffuser plates are secured in the housing in the path of movement of the air/gas mixture through the housing opening. The diffuser plates include a spacer 20, secured to the housing in the enlarged opening 14 in the second portion 13 so as to extend across and be spaced from the communicating portion 15, and a baffle 21, connected to spacer 20 so as to form a restricted slit orifice extending along the sides and ends thereof through which the air/gas mixture is directed upon firing thereof. A plenum 22 is formed in the space defined by spacer 20 and baffle 21, the communicating portion 15 of the opening which extends through housing 10, and portions of the walls of the housing 10 opposite spacer 20 and baffle 21 and proximate communicating portion 15. The spacer 20, baffle 21 and plenum 22 enable substantial pressure to be generated in movement of the air/gas mixture through housing 10, and spread the path of movement of such mixture throughout the enlarged opening 14.

The structure still further includes a refractory 30, positioned in the enlarged opening 14 in the housing second portion 13 so as to be seated in ledge 16 therein, and spaced from the spacer 20 and baffle 21 so as to form an airspace 31 therebetween. The air/gas mixture, under pressure imparted by the diffuser plates, fires through refractory 30, and is ignited at the outwardly-facing surface thereof. The ignited air/gas mixture heats the outer surface of refractory 30 so as to generate infrared radiation.

A portion of the infrared radiation generated by refractory 30 may be transferred to housing 10, and may flesh over to adjacent burner articles, if insulation is not provided. To inhibit such transfer and flash over, insulation 32 is positioned so as to extend about the sides and ends of refractory 30, in order to insulate housing 10 from refractory 30. A flexible sealant 32' may be applied, so as to flexibly seal insulation 32 and refractory 30 in the enlarged opening 14 in the second portion 13 of housing 10. The flexible sealant may comprise, for example, silicone. Insulation 32 and the flexible sealant take up expansion and contraction in refractory 30, and prevent cracking of refractory 30. To remove the sealant, for replacement of refractory 30 in the event the refractory wears down, the sealant may be pried away with use of a sharp-edged tool to gouge out the sealant, remove the insulation may then be removed, the refractory may be replaced with a new refractory, the insulation may be replaced, and new sealant may be applied about the new refractory and insulation to reseal same in housing 10.

The infrared radiating burner article fires the air/gas mixture through the opening extending through housing 10, and through refractory 30. Substantial pressure is generated in the air/gas mixture as it moves through restricted opening 12, plenum 22, and the slit orifice formed so as to extend along the sides and ends of spacer 20 and baffle 21. Such pressurized air/gas mixture flows through refractory 30 so as to heat same, and is ignited on the outer surface thereof by an igniter such as an electrode. The ignited air/gas mixture burns on the outer surface of refractory 30, and heats same so as to generate infrared radiation. Refractory 30 reaches the point where it emits the desired radiation in a relatively short period of time after system start-up, and reaches the point where it has cooled down in a relatively short period of time after the system is shut down, such time periods being on the outwardly-facing surface area, so as to generate substantial quantities of infrared radiation. Rapid generation of infrared radiation, as provided by the article, enables efficient use of fuel therefor. Firing the air/gas mixture through refractory 30 so as to heat refractory 30, such mixture being under substantial pressure generated by movement thereof through the diffuser plates, and the ignited air/gas mixture burning on the outwardly facing surface of refractory 30 and heating same, generates substantial quantities of infrared radiation at limited gas pressures, in a rapid and efficient manner. Less gas may be utilized to generate a quantity of infrared radiation output. The ignited air/gas mixture burns on the surface of the refractory grid and heats same so as to generate increased infrared radiation at a particular gas pressure, in a rapid and efficient manner.

The structure still further includes a wire screen 40, for reverberating infrared radiation generated by refractory 30, so as to aid in the distribution of heat generated thereby and increase the intensity of the infrared radiation transferred to the product being heated, for more efficient heating of such product. The infrared radiation generated thereby is high density flux of maximum density. Wire screen 40 is secured to the second portion 13 of housing 10 so as to be spaced from the outwardly-facing surface of refractory 30, in the path of infrared radiation generated thereby. Reverberation provided thereby is akin to a sounding-board effect, with infrared radiation being reverberated and transferred to the product being heated. Wire screen 40 is detachably connected to housing 10, so as to enable removal thereof for removal and replacement of refractory 30 at the user's place of business in a convenient and efficient manner.

Firing the combusted air/gas mixture through the refractory 30, and reverberating infrared radiation generated by refractory 30 through wire screen 40, enables the structure to be fired from any position relative to the material to be heated thereby, which enables efficient use and operation of the article.

Thus, the structure includes a housing connectable to the air and gas mixing and supplying system. The housing has a continuous opening extending therethrough, through which the air/gas mixture is fired. The structure further includes diffuser plates, positionable in the housing so as to form a plenum in the path of movement of the air/gas mixture through the housing opening, and so as to generate substantial pressure in the air/gas mixture as it is fired through the opening in the housing. The structure still further includes a refractory, positioned in the opening in the housing in the path of movement of the air/gas mixture therethrough, through which the air/gas mixture is fired so as to heat same. An igniter, which may comprise an electrode, for example, ignites the air/gas mixture at the outwardly-facing surface of the refractory, such that the flame burns such surface to heat same, so as to generate infrared radiation thereby for heating the material.

The system for mixing the air/gas mixture for supplying same to the article includes an air injector for inspirating air into a stream of gas so as to form the air/gas mixture and firing the air/gas mixture through the refractory. The structure further includes a wire screen, secured to the housing in the path of radiation of infrared generated by the refractory, which reverberates the infrared radiation so as to enhance distribution of heat generated and increase the intensity thereof, for heating material in a more efficient and economical manner. The article still further includes insulation positioned intermediate the refractory grid and housing so as to insulate the housing from the refractory grid, and insulate the article from adjacent articles, and flexible sealant for flexibly sealing the refractory grid and insulation in the housing, enabling removal of the sealant to effectuate replacement of the refractory at the user's place of business in a convenient and efficient manner. The insulation and flexible sealant take up expansion and contraction of the refractory and prevent cracking thereof. The article still further includes a threaded connector portion of the housing, which enables detachable connection of the article to the air/gas mixture supplying means to enable replacement of the burner at the user's place of business in a convenient and efficient manner.

The foregoing description is illustrative of the preferred embodiment of the invention. It is to be understood that additional embodiments thereof would be obvious to those skilled in the art. Therefore, the embodiments described herein, together with such additional embodiments, are within the scope of the invention. Thus, the invention is to be broadly construed within the scope and spirit of the claims appended hereto.

I claim:

1. An infrared radiating burner article for generating infrared radiation, connectable to means for mixing air and gas and supplying such air/gas mixture thereof, comprising:

(a) a housing, having a restricted inlet opening in communication with an enlarged opening extending therethrough, through which the air/gas mixture may be fired;

(b) means for diffusing the air/gas mixture upon firing thereof through the housing opening so as to generate substantial pressure in such air/gas mixture, secured in the housing opening in the path of movement of the air/gas mixture upon firing thereof through the housing opening, said diffuser means including a plate confronting said inlet opening to form a slit orifice along the sides thereof;

(c) a refractory grid, positioned in the housing opening in the path of movement of the air/gas mixture therethrough upon firing thereof through the housing opening, at a point beyond the location of the diffusing means in such path, such that the air/gas mixture is fired through the refractory grid, which refractory grid includes a surface thereof facing outwardly from the housing;

(d) means for igniting the air/gas mixture, upon firing thereof through the refractory grid, at the outwardly facing surface of the refractory grid such that the flame heats the outwardly facing surface of the refractory grid so as to generate infrared radiation thereby;

(e) means for reverberating infrared radiation generated by the refractory grid, secured to the housing so as to be spaced from the outwardly facing surface of the refractory grid in the path of infrared generated thereby, said reverberating means being a screen lying in a spaced relationship to said refractory grid;

(f) means for enabling the article to be detachably connected to the means for mixing and supplying the air/gas mixture, said means for detachably connecting said article including external threads mounted on restricted portion of said housing, said restricted portion having a restricted opening directing said air/gas mixture to said diffusing means for delivery to said opening; and (g) said housing having tapered walls, adjacent said slit orifice between said orifice and said refractory grid.

2. An article as in claim 1, further comprising means for insulating the refractory grid from the housing.

3. An article as in claim 1, in which the means for mixing and supplying the air/gas mixture include means for inspirating air into a stream of gas so as to mix air and gas.

4. An article as in claim 1, in which the housing includes a ledge on the walls of the opening, on which the refractory grid is positioned.

5. An article as in claim 1, further comprising means for flexibly sealing the refractory grid and insulating means in the housing.

6. A structure as in claim 1, in which the diffusing means are secured to the housing so as to extend across and be spaced from the portion of the opening restricted portion communicating with the opening enlarged portion such that a plenum is formed in the space defined by the diffusing means, the portion of the opening restricted portion communicating with the opening enlarged portion, and the portions of the walls of the housing opposite the diffusing means and proximate the opening restricted portion.

7. A structure as in claim 1, in which the refractory is positioned in the enlarged portion of the housing opening so as to be spaced from the diffusing means to form an airspace therebetween.

* * * * *